US005559489A

United States Patent [19]

Weiden

[11] Patent Number: 5,559,489

[45] Date of Patent: Sep. 24, 1996

[54] FUSE HOLDER FOR AN ELECTRIC SWITCH

[75] Inventor: Conrad Weiden, Chapel Hill, N.C.

[73] Assignee: Square D Company, Palatine, Ill.

[21] Appl. No.: 305,375

[22] Filed: Sep. 13, 1994

[51] Int. Cl.[6] ..... H01H 85/14

[52] U.S. Cl. ..... 337/215; 337/213; 337/187; 337/201; 361/646; 361/833; 439/622

[58] Field of Search ..... 337/186, 187, 337/297, 190, 201, 211, 213; 361/833, 835, 642, 646

[56] References Cited

U.S. PATENT DOCUMENTS

| | | | |
|---|---|---|---|
| 4,013,989 | 3/1977 | Born | 337/186 |
| 4,302,643 | 11/1981 | Cox | 200/144 R |
| 4,938,715 | 7/1990 | Jones | 439/621 |
| 5,365,395 | 11/1994 | Callaway | 361/56 |
| 5,426,406 | 6/1995 | Morris | 335/202 |
| 5,434,376 | 7/1995 | Hyatt | 200/293 |

*Primary Examiner*—Gernald P. Tolin
*Assistant Examiner*—Stephen T. Ryan
*Attorney, Agent, or Firm*—Larry I. Golden; Kareem M. Irfan

[57] ABSTRACT

The present invention provides a fuse holder as part of an integrated switch base assembly for attachment to a fusible switch having one or more phases between the line and load side of a circuit. The fusible switch has a switch base assembly for opening and closing a switch contact. The switch base assembly has a mounting surface. The fuse holder includes a generally planar base made of electrically-insulating material. The base has a top and bottom face. The top face has a plurality of upstanding walls integrally formed therewith which define a compartment corresponding to each phase. The bottom face has a contoured surface adapted to abut the mounting surface of the switch base assembly. A first and second fuse clip correspond to each phase and are secured on opposite ends of the top face within the compartment. A terminal connects to the load side of the circuit and electrically and mechanically connects to the first fuse clip. The fuse holder includes an elongated connector having two ends. One end of the connector electrically and mechanically connects to the second fuse clip. The opposite end of the connector is adapted to electrically connect to the switch contact and the line side of the circuit. The fuse holder secures the base to the mounting surface of the switch base assembly.

17 Claims, 3 Drawing Sheets

FUSE HOLDER FOR AN ELECTRIC SWITCH

RELATED APPLICATION

Related co-pending U.S. application Ser. No. 08/109,419, filed on Aug. 19, 1993, now U.S. Pat. No. 5,434,376 discloses one class of fuse clips and methods of fastening fuse clips which is suitable for use in the present application. The entire teaching and disclosure of that co-pending application is incorporated herein by reference.

FIELD OF THE INVENTION

The present invention relates to fusible switches, disconnect switches, and the like, which have a fuse holder and, more particularly, to a fuse holder which saves panel space by mounting on top of the switch base assembly.

BACKGROUND OF THE INVENTION

A fusible switch is usually mounted in an enclosure and incorporates an insulating base to carry an incoming line terminal for each phase. The circuit for each phase is completed through a pivotal knife blade which engages a corresponding contact stab and is electrically connected with a fuse clip having a fuse seated therein. In U.S. Pat. No. 4,302,643, commonly assigned to the Square D Company, a fusible switch is shown utilizing the above-mentioned construction and which is hereby incorporated by reference.

Fusible switches are used in switchboards to distribute power for commercial and industrial applications. The need arises to distribute more power through enclosures which are the same size or smaller. This requires increasing the electrical rating of the switch to carry a higher voltage and current density while decreasing the size of the enclosure housing the electrical parts.

Among the problems caused by decreasing the space requirements of a switch is the additional hardware necessary for mounting different types and classes of fuses in a fusible switch. Usually, only one class of fuse will fit in a fuse holder. Furthermore, mounting screws are used to attach and retain fuse clips and other terminals to switch base interiors. The need arises to assemble the fuse switches in increasingly smaller enclosures providing little room for maneuvering.

A switch must be economical to manufacture. A switch with a comparable electrical rating requiring less panel space allows more wide-spread application. This also alleviates the problem of selecting an appropriate class of fuse.

SUMMARY OF THE INVENTION

Accordingly, the present invention provides a fuse holder for attachment to a fusible switch having one or more phases between the line and load side of a circuit. The fusible switch has a switch base assembly for opening and closing a switch contact. The switch base assembly has a mounting surface. The fuse holder includes a generally planar base made of electrically-insulating material. The base has a top and bottom face. The top face has a plurality of upstanding walls integrally formed therewith which define a compartment corresponding to each phase. The bottom face has a contoured surface adapted to abut the mounting surface of the switch base assembly. A first and second fuse clip correspond to each phase and are secured on opposite ends of the top face within the compartment. Terminal means connects to the load side of the circuit and electrically and mechanically connects to the first fuse clip. The fuse holder includes an elongated connector having two ends. One end of the connector electrically and mechanically connects to the second fuse clip. The opposite end of the connector is adapted to electrically connect to the switch contact and the line side of the circuit. The fuse holder provides means for securing the base to the mounting surface of the switch base assembly. The securing means is coupled to the base.

The present invention also contemplates an integrated switch base assembly for terminals connecting a fusible switch having one or more phases between the line and load side of a circuit. The switch base assembly includes an assembly base formed of electrically insulating material and having a mounting surface. A first terminal means connects to the line side of the circuit. The first terminal means is secured to the assembly base. A second terminal means is secured to the assembly base. A switch contact electrically and mechanically connects in a reversible manner the first terminal means to the second terminal means. The switch contact is secured to the base assembly. The switch base assembly includes a fuse holder as described above which provides third terminal means for connecting to the load side of the circuit. The third terminals means electrically and mechanically connects to the first fuse clip on the fuse holder.

The present invention also provides a fusible switch for one or more phases between the line and load side of a circuit. The switch includes an enclosure defining a switch interior formed by sidewalls, a backwall, and a frontwall. The frontwall has a cover removably connected thereto. The switch includes a switch base assembly base as described above which is secured to one of the walls of the enclosure.

An object of the present invention is to provide a switch capable of operating at a comparable voltage and current density requiring less panel space and having a more compact design.

Another object of the present invention is to provide a fuse holder which reduces the part count and manual labor needed for completed assembly compared to the prior art.

A further object of the present invention is to provide a switch having a fuse holder which is inexpensive to manufacture and accommodates a variety of fuse types without additional hardware for installation.

Other and further advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DESCRIPTION OF THE PREFERRED EMBODIMENT

Figure 1:
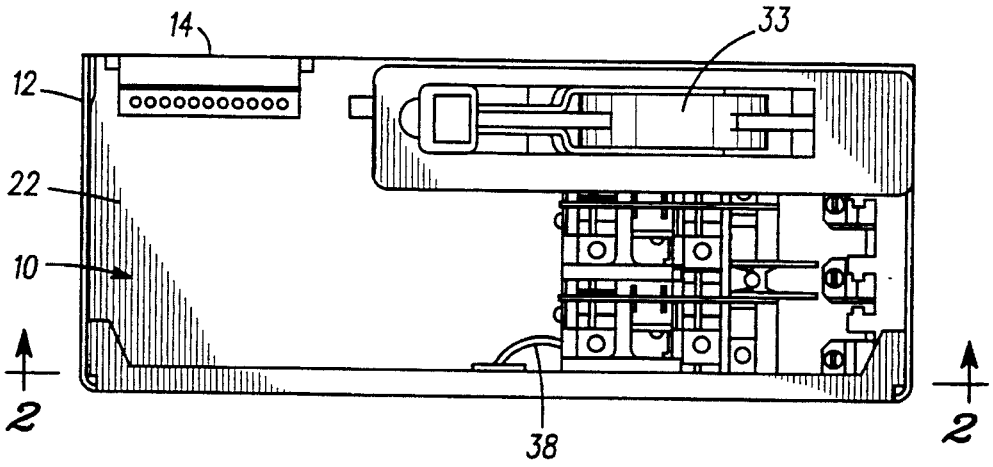
FIG. 1 is a front plan view of a fusible switch with the cover panel removed to expose an integrated switch base assembly and fuse holder of the present invention.
Figure 2:
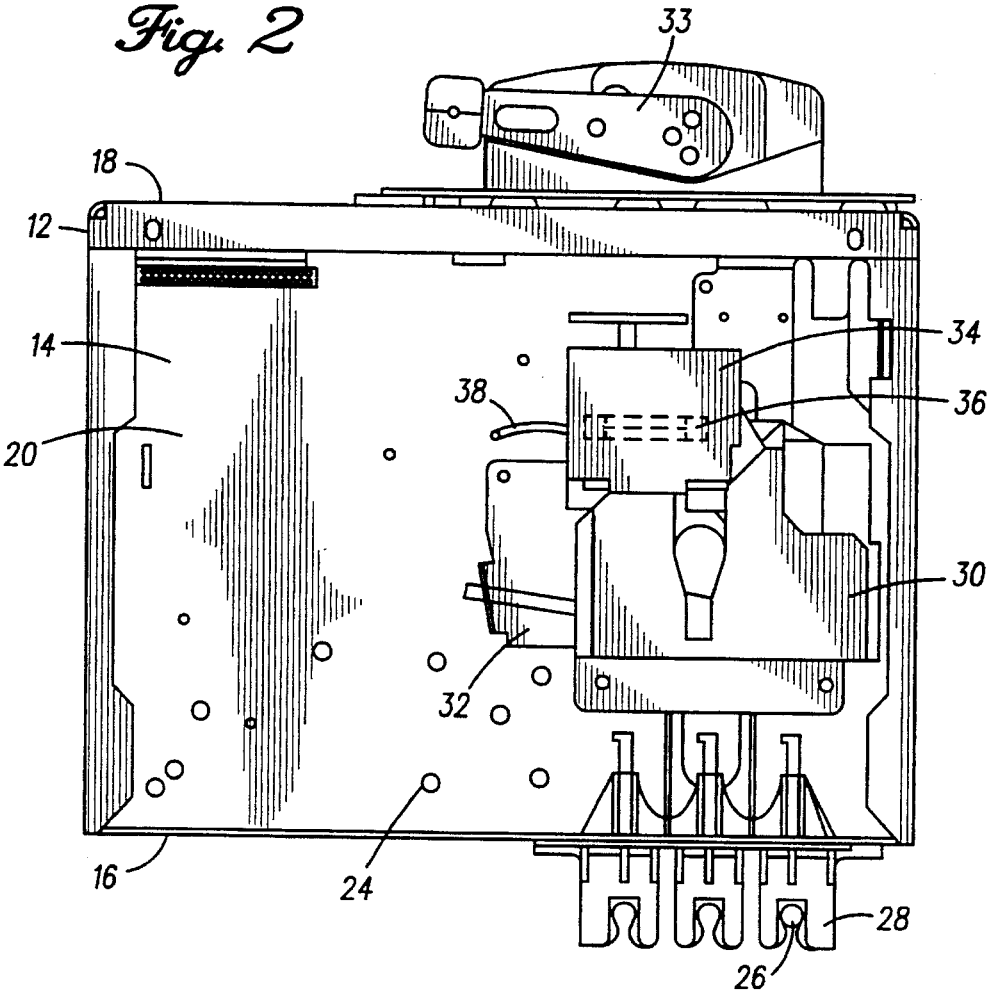
FIG. 2 is a cross-sectional side view of the fusible switch, integrated switch base assembly and fuse holder along lines 2—2 on FIG. 1.

Referring now to FIGS. 1 and 2, a fusible switch for a multi-phase circuit is generally indicated by the reference numeral 10. The switch 10 includes an enclosure 12 defined by sidewalls 14, a backwall 16, and a frontwall 18. The switch 10 is enclosed by cover panels like side panel 20 and back 22 which connect to the sidewall 14 and back wall 16, respectfully. Mounting holes 24 are formed in the sidepanel 20 and are utilized to attach components within the enclosure 12.

In a multi-phase circuit, there is an electrical power line like 26 for each respective phase. A contact jaw 28 electrically and mechanically connects to the power line 26. The contact jaw 28 is secured to the backwall 16. The switch 10 described and illustrated herein is for a three-phase circuit. In accordance with the teachings available in the electrical art, it would be within the skill of one to change the number of phases and modify the invention accordingly.

The switch 10 includes an integrated switch base assembly 30 providing connections to both the line and load side of the circuit. The switch base assembly 30 is mounted within the interior of the enclosure 12. The power line 26 enters the enclosure 12 through the contact jaw 28 to connect the line side of the circuit to the base assembly 30. Each phase of the circuit continues across the switch base assembly 30 for opening and closing a switch contact (not shown). A handle 33 connects to an operating mechanism 32 to permit control of the switch contact external to the enclosure 12. The switch base assembly 30 connects to a fuse holder 34 which continues the circuit across a fuse 36 illustrated in phantom. For each phase there is an outgoing load line 38 connecting to the fuse holder 34 and extending to the sidewall 14 to make an external connection with the power distribution system.

The switch base assembly 30 is formed of a known electrically-insulating material such as the thermoplastic sold by the General Electric Company under the name Valox 420 or 750. The switch base assembly 30 is secured to the side wall 14 by means of a mounting bracket 40 as illustrated specifically in FIG. 4. Any conventional means for fastening the switch base assembly 30 such as a sheet metal screw 42 or a bolt, is suitable. Alternatively, the switch base assembly 30 can be mounted directly to one of the panels or framework of the switch 10, using the side panel 20, back panel 22, or the like.

Figure 3:
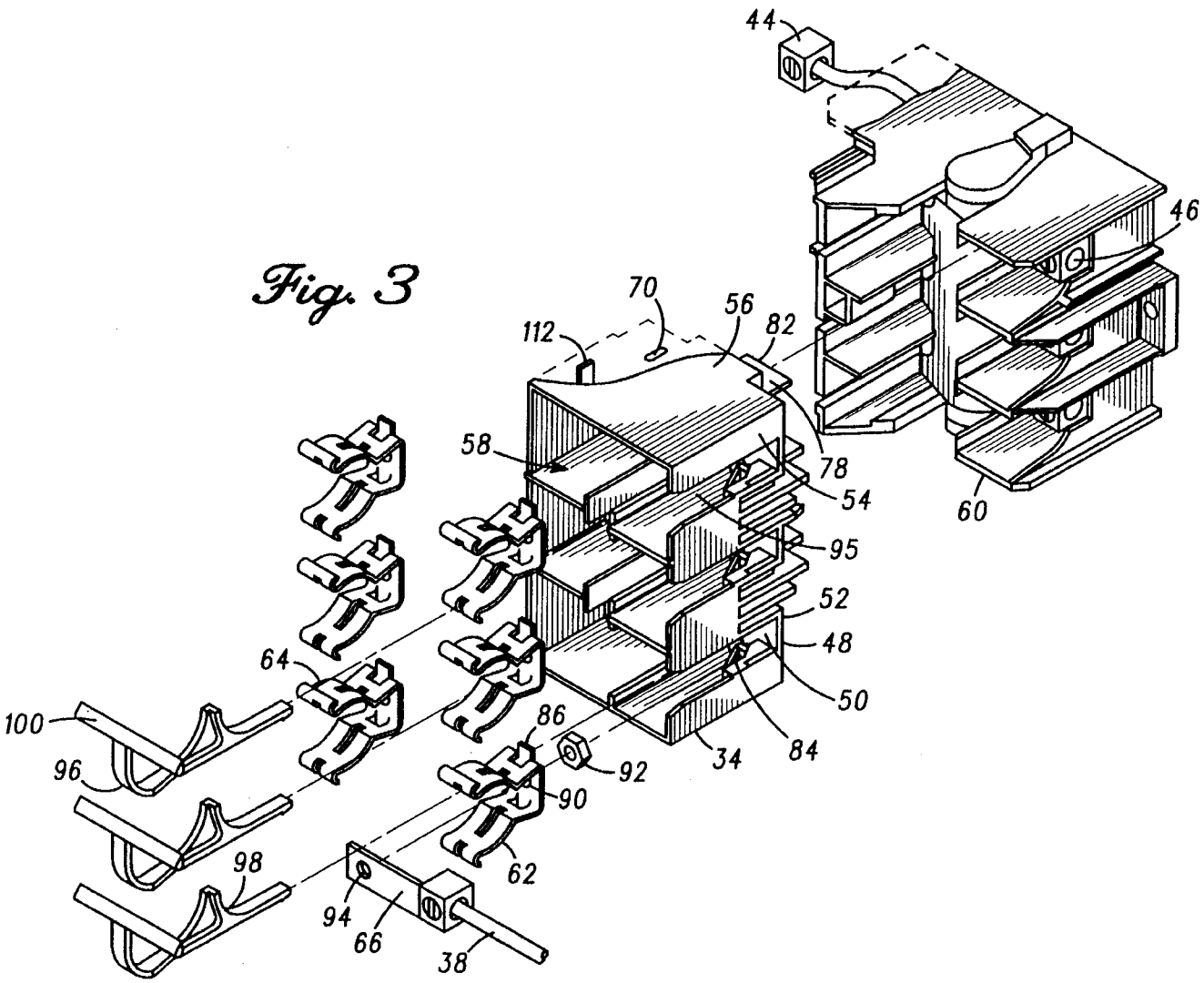
FIG. 3 is an exploded perspective view of a partially cut-away fuse holder with the switch base assembly.

The switch base assembly 30 includes a first terminal 44 as illustrated in FIG. 3 for connecting to the line side of the circuit by means of electrically connecting to the contact jaw 28 and power line 26. The first terminal 44 is connected to one side of the switch contact. A second terminal 46 is also secured to the switch base assembly 30 and connects to the load side of the circuit. The second terminal 46 connects to the side of the switch contact opposite the first terminal 44. Although conventional lug bodies are suitable for use to provide electrical and mechanical connection, the present invention contemplates using other terminal means.

The operating mechanism 32 is secured to the switch base assembly 30. Any conventional switch operating mechanism is suitable for use with the present invention. For example, the operating mechanism 32 can use a switch contact electrically connected to power line 26 through the first terminal 44. The opposite side of switch contact is electrically connected to the load side of the circuit through the second terminal 46. An example of a conventional switch contact is a knife blade terminal (not shown) is configured to mechanically and electrically connect across the switch contact. The present invention contemplates the use of other switch contact means for electrically and mechanically completing each phase of the circuit.

The second terminal 46 electrically connects to the fuse holder 34. The fuse holder includes a generally planar base 48 having a top face 50 and a bottom face 52. The top face 50 is integrally formed with a plurality of upstanding walls like 54, 56 which define a compartment 58 corresponding to each phase. The bottom face 52 has a contoured surface for directly abutting a mounting surface 60 on the switch base assembly 30.

The fuse holder 34 mounts multiple phases on spaced apart positions on the base 48. Each phase includes a first fuse clip 62 and a second fuse clip 64. The first and second fuse clips 62, 64 are secured on opposite ends of the top face 50 of the base. The first fuse clip 62 electrically and mechanically connects to a third terminal 66. The third terminal 66 connects to the load side of the circuit through load line 38.

Figure 4:
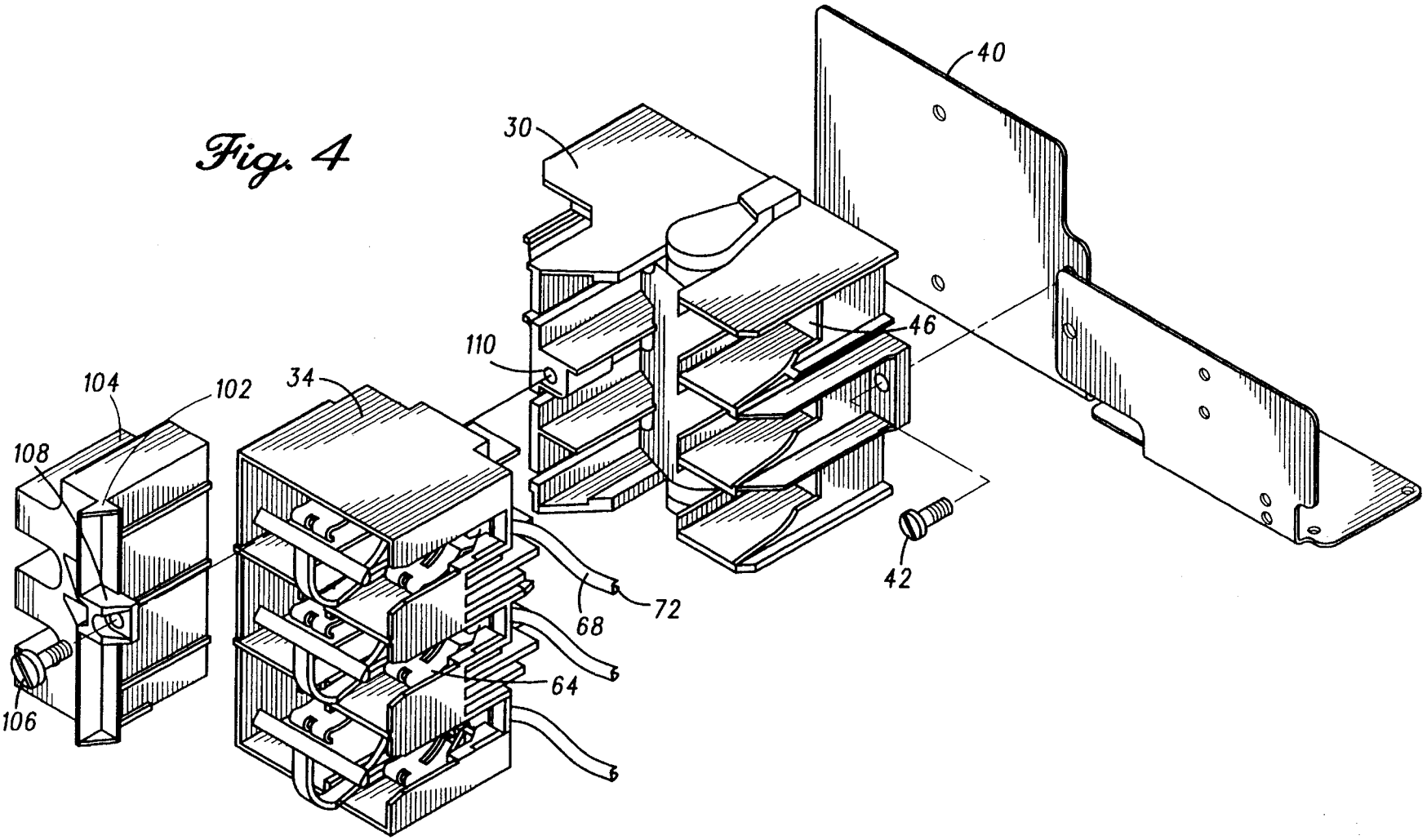
FIG. 4 is an exploded perspective view of the fuse holder and switch base assembly with an alternative embodiment of making the electrical connection therebetween.

The fuse holder 34 includes an elongated connector 68 illustrated in FIG. 4 which is electrically conductive to make the connection between the second fuse clip 64 and the second terminal 46. The connector 68 has two ends. One end of the connector 68 attaches to the second fuse clip 64. Preferably, the connector 68 extends through a connector aperture 70 through the base 48 of the fuse holder. The opposite end 72 of the connector fastens to the second terminal 46.

Preferably, the connector 68 is a flexible cable with an electrically-insulating cover and fastening means on each end. The present invention contemplates using any electrically-conductive connector means for connecting the second fuse clip 64 and the second terminal 46 while maintaining the desired orientation between the switch base assembly 30 and the fuse holder 34. Any conventional fastening means between electrical terminals and the connector 68 is suitable for use by the present invention. Preferably, the end 72 of the connector uses an eyelet as a fastener. Another suitable fastening means, meant for example and not for limitation, is the conventional lug body used as the second terminal 46 illustrated in FIG. 3 which can electrically connect to the end of a bare wire or cable.

Preferably, the bottom face 52 of the base includes upstanding tabs 78 integrally formed therewith which define a u-shaped channel 80 corresponding to each phase. The channel 80 extends across the bottom face 52 of the base and has a cross-sectional size sufficient to accommodate the elongated connector 68 through the channel 80. The upstanding tabs 78 have a top edge 82 which abuts the mounting surface 60 of the operating mechanism when the fuse holder 34 is secured thereto.

The fuse clips 62 and 64 are secured to the fuse holder 34 with a plurality of prongs like 84 which upstand from the top face 50 of the base within the compartment 58. Each prong has an undercut between the top face 50 and the end of the prong to define a retaining flange. The undercut of the prong 84 retains the edges like 86 of the fuse clip in order to prevent movement of the fuse clip.

Fuse clip 62 includes a fastener hole 90 centrally located in the base of the fuse clip. The third terminal 66 is illustrated in FIG. 3 as a conventional lug body having a tab extending therefrom with a lug fastener hole 94 positioned on the tab to overlap the fastener hole 90 of the fuse clip. In turn, the fastener hole 90 and the lug fastener hole 94 are positioned to overlap a depression (not shown) in the top face 50 of the base. Preferably, the depression is in the shape of a hexagonal nut so that a similarly shaped nut 92 is placed within the depression. The sides of the nut 92 abut the walls of the depression preventing the nut 92 from rotating. A conventional threaded fastener like a screw (not shown) inserts through the fastener hole 90 and the lug fastener hole 94 to engage the nut 92 and mechanically and electrically secure the tab and lug body of the third terminal 66 to the fuse clip 62. Consequently, the third terminal 66 is secured to the base 48 because the fuse clip 62 is already secured by the prongs 84 and undercut. An aperture 95 is provided in the upstanding wall 54 so that the third terminal 66 can extend therethrough and connect to the load line 38 external to the compartment. Other means for electrically and mechanically connecting the fuse clip 62 and the third terminal 66 and provide connection to the load side of the circuit is contemplated by the present invention.

The fuse holder 34 preferably includes a fuse puller 96 which is retractably positioned within the upstanding walls 56 of the compartment. The fuse puller 96 has fuse flange 98 which engages the fuse 36 and a fuse handle 100 which extends above the upstanding walls 56 so as to be manually accessible to an operator. As the fuse handle 100 is pulled upward, the fuse flange 98 lifts the fuse 36 out of the compartment 58 so that it can be grasped by the operator. The fuse puller 96 can then be retracted into the compartment 58 with or without a replacement fuse.

The fuse holder 34 includes means for securing the base 48 to the mounting surface 60. As illustrated in FIG. 4, the fuse holder 34 is preferably secured to the base assembly 30 by abutting a flange 102 on an arc suppressor 104. A conventional screw 106 engages a foot 108 on the arc suppressor 104 and secures to the switch base assembly 30 at hole 110. The arc suppressor flange 102 abuts a flange 112 positioned on the exterior side of the compartment 58 as specifically illustrated by FIG. 3. Consequently, the top edges 82 of the upstanding tabs abut the mounting surface 60 and are retained in position therewith.

Preferably, the fuse holder 34 is secured directly to a mounting surface 60 on the switch base assembly. As a result, the position of the third terminal 66 and the position of the end 72 of the elongated connector connecting to the second terminal 46 are juxtaposed. The present invention can use any mounting surface on the switch base assembly 30 to secure the fuse holder 34 thereto. Since the fuse holder 34 is mounted directly to the switch base assembly 30, the present invention integrates the line and load side terminals with the fuse holder into one compact assembly.

The present invention is preferably used with J-class fuses. One of the advantages of the inventive fuse holder is the capability to use both 30-amp and 60-amp fuses without changing the dimensions of the fuse holder. It should be understood, however, that fuses having a different rating and class can be used in the switch by modifying the dimensions of the fuse holder and the configuration of the fuse clips therein.

While particular embodiments and applications of the present applications of the present invention have been illustrated and described, it is to be understood that the invention is not limited to the precise construction disclosed herein and that various modifications, changes, and variations will be apparent to those skilled in the art may be made in the arrangement, operation, and details of construction of the invention disclosed herein without departing from the spirit and scope of the invention as defined in the appended claims.

I claim:

1. A fuse holder for attachment to a fusible switch having one or more phases between the line and load side of a circuit, the fusible switch having a switch base assembly for opening and closing a switch contact, the switch base assembly having a mounting surface, the fuse holder comprising:

a generally planar base made of electrically-insulating material, the base having a top and bottom face, the top face having a plurality of upstanding walls integrally formed therewith which define a compartment corresponding to each phase, the bottom face having a contoured surface adapted to abut the mounting surface of the switch base assembly, bottom face having a plurality of upstanding tabs integrally formed therewith which define a u-shaped channel corresponding to each phase, the channel extending across the bottom face of the base and having a cross-sectional size sufficient to accommodate the elongated connector therethrough, the plurality of upstanding tabs being adapted to abut the mounting surface of the switch base assembly;

a first and second fuse clip corresponding to each phase, the first and second fuse clip being secured on opposite ends of the top face within the compartment;

terminal means for connecting to the load side of the circuit, the terminal means electrically and mechanically connecting to the first fuse clip;

an elongated connector having two ends, one end of the connector electrically and mechanically connecting to the second fuse clip, the opposite end of the connector being adapted to electrically connect to the switch contact and the line side of the circuit;

means for securing the base to the mounting surface of the switch base assembly, the securing means being coupled to the base.

2. The fuse holder defined in claim 1 wherein the position of the terminal means and the position of the opposite end of the elongated connector being adapted to connect to the switch contact are juxtaposed.

3. The fuse holder defined in claim 1 wherein the fuse holder further includes a fuse puller retractably positioned between the upstanding walls of the compartment, the fuse puller having a fuse flange being adapted to engage a fuse, one end of the fuse puller extending above the upstanding walls whereby the fuse puller is manually accessible to retractably move the fuse upward.

4. The fuse holder defined in claim 1 wherein the compartment further includes a plurality of prongs upstanding from the top face of the base within the compartment, each prong having an undercut between the top face and the end of the prong to define a retaining flange, the undercut of each prong being adapted to retain the edges of each fuse clip and prevent movement of the fuse clip.

5. The fuse holder defined in claim 1 wherein the securing means includes a flange integrally formed with and extending outwardly from one of the upstanding walls of the compartment, the flange being adapted to abut a corresponding flange having a fastener which secures to the switch base assembly.

6. The fuse holder defined in claim 1 wherein the elongated connector is an insulated cable having a fastener on both ends.

7. The fuse holder defined in claim 1 wherein the base further includes a connector aperture therethrough, the connector aperture being positioned near the first fuse clip and having sufficient size to allow the elongated connector passage therethrough.

8. The fuse holder defined in claim 1 wherein the one of the upstanding walls further includes an aperture being positioned near the second fuse clip, the aperture allowing the terminal means to extend through the upstanding wall for electrical connection outside of the compartment.

9. The fuse holder defined in claim 1 wherein the fuse holder is suitable for use with 30 amp and 60 amp J-type fuses without changing the dimensions of the fuse holder.

10. An integrated switch base assembly for terminals connecting a fusible switch having one or more phases between the line and load side of a circuit, the assembly comprising:

an assembly base formed of electrically insulating material and having a mounting surface;

first terminal means for connecting to the line side of the circuit, the first terminal means being secured to the assembly base;

second terminal means being secured to the assembly base;

a switch contact for electrically and mechanically connecting in a reversible manner the first terminal means to the second terminal means, the switch contact being secured to the base assembly; and a fuse holder having:

a generally planar base made of electrically-insulating material, the base having a top and bottom face, the top face having a plurality of upstanding walls integrally formed therewith which define a compartment corresponding to each phase, the bottom face having a contoured surface adapted to abut the mounting surface of the assembly base, the bottom face having a plurality of upstanding tabs integrally formed therewith which define a u-shaped channel corresponding to each phase, the channel extending across the bottom face of the base and having a cross-sectional size sufficient to accommodate the elongated connector therethrough, the plurality of upstanding tabs being adapted to abut the mounting surface of the base assembly;

a first and second fuse clip corresponding to each phase, the first and second fuse clip being secured on opposite ends of the top face within the compartment;

third terminal means for connecting to the load side of the circuit, the third terminal means electrically and mechanically connecting to the first fuse clip;

an elongated connector having two ends, one end of the connector electrically and mechanically connecting to the second fuse clip, the opposite end of the connector electrically and mechanically connecting to the second terminal means; and means for securing the base to the mounting surface of the base assembly, the securing means being coupled to the base.

11. The assembly defined in claim 10 wherein the position of the third terminal means and the position of the opposite end of the elongated connector connecting to the second terminal means are juxtaposed when the means secures the base to the mounting surface of the base assembly.

12. The assembly defined in claim 10 wherein the base further includes a connector aperture therethrough, the connector aperture being positioned near the first fuse clip and having sufficient size to allow the elongated connector passage therethrough.

13. A fusible switch for one or more phases between the line and load side of a circuit, the switch comprising:

an enclosure defining a switch interior formed by sidewalls, a backwall, and a frontwall, the frontwall having a cover removably connected thereto;

an assembly base formed of electrically insulating material, the assembly base having a generally planar mounting surface and being secured to one of the walls of the enclosure;

first terminal means for connecting to the line side of the circuit, the first terminal means being secured to the assembly base;

second terminal means being secured to the assembly base;

a switch contact for electrically and mechanically connecting in a reversible manner the first terminal means to the second terminal means, the switch contact being secured to the base assembly and having a handle accessible from the exterior of the enclosure; and a fuse holder having:

a generally planar base made of electrically-insulating material, the base having a top and bottom face, the top face having a plurality of upstanding walls integrally formed therewith which define a compartment corresponding to each phase, the bottom face having a contoured surface adapted to abut the mounting surface of the base assembly, the bottom face having a plurality of upstanding tabs integrally formed therewith which define a u-shaped channel corresponding to each phase, the channel extending across the bottom face of the base and having a cross-sectional size sufficient to accommodate the elongated connector therethrough, the plurality of upstanding tabs being adapted to abut the mounting surface of the base assembly;

a first and second fuse clip corresponding to each phase, the first and second fuse clip being secured on opposite ends of the top face within the compartment;

third terminal means for connecting to the load side of the circuit, the third terminals means electrically and mechanically connecting to the first fuse clip;

an elongated connector having two ends, one end of the connector electrically and mechanically connecting to the second fuse clip, the opposite end of the connector electrically and mechanically connecting to the second terminal means; and means for securing the base to the mounting surface of the base assembly, the securing means being coupled to the base.

14. The switch defined in claim 13 wherein the position of the terminal means and the position of the opposite end of the elongated connector being adapted to connect to the switch contact are juxtaposed when the means secures the base to the mounting surface of the base assembly.

15. The switch defined in claim 13 wherein the securing means includes a flange integrally formed with and extending outwardly from one of the upstanding walls of the compartment, the switch further includes an arc suppressor having a mating flange corresponding to the flange and being adapted to abut one another, the arc suppressor having a fastener which connects to the mounting surface of the base assembly.

16. The switch defined in claim 13 wherein the base further includes a connector aperture therethrough, the connector aperture being positioned near the first fuse clip and having sufficient size to allow the elongated connector passage therethrough.

17. The switch defined in claim 13 wherein one of the upstanding walls further includes an aperture being positioned near the second fuse clip, the aperture allowing the terminal means to extend through the upstanding wall for electrical connection external to the compartment.

* * * * *